United States Patent [19]

Wood et al.

[11] Patent Number: 4,938,283

[45] Date of Patent: Jul. 3, 1990

[54] BELL ORIFICE PLATE FOR INSHOT COMBUSTION FURNACE

[75] Inventors: Richard J. Wood, North Syracuse; Robert H. Swieczkowski, Cazenovia, both of N.Y.; Ninev K. Zia, Clermont, Ind.

[73] Assignee: Carrier Corporation, Syracuse, N.Y.

[21] Appl. No.: 369,065

[22] Filed: Jun. 19, 1989

[51] Int. Cl.[5] ..... B22D 1/00

[52] U.S. Cl. ..... 165/135; 126/99 A; 126/104 R; 126/114; 126/112; 165/53

[58] Field of Search ..... 126/39 N, 112, 114, 126/104 R, 99 A; 165/53, 135

[56] References Cited

U.S. PATENT DOCUMENTS 4,476,850 10/1984 Pickering ..... 126/112
4,515,145 5/1985 Tallman et al. ..... 126/112 X
4,776,320 10/1988 Ripka et al. ..... 126/116 R X

OTHER PUBLICATIONS

Day and Night-Formula 1000 Brochure, date approx. 1987.

*Primary Examiner*—Larry Jones
*Attorney, Agent, or Firm*—Wall and Roehrig

[57] ABSTRACT

A belled orifice inlet plate is provided for an induced draft combustion furnace heat exchanger of the type in which an inshot burner produces a hot gaseous combustion that is injected through an opening in the inlet plate into a combustion zone in the heat exchanger. The inlet plate has a flared collar that surrounds the opening at its periphery, and which extends a predetermined distance into the combustion zone. Preferably, the collar should have a depth on the order of one-quarter inch to one-half inch, and the flared portion should have a radius of curvature on the order of about one-quarter inch.

8 Claims, 2 Drawing Sheets

BELL ORIFICE PLATE FOR INSHOT COMBUSTION FURNACE

BACKGROUND OF THE INVENTION

This invention relates to heating, ventilation, and air conditioning (HVAC) equipment, and is more particularly related to combustion systems and heat exchangers for furnaces.

Combustion systems such as furnaces generate noise because, by necessity, there are gases flowing in and around the burner and the heat exchanger of the furnace. In some instances, the sound level may be high enough to be unpleasant or unacceptable. In such systems, the combustion process itself is a dominant factor in the generation of noise. Normally, this arises because of the turbulent flow of the combustion air and of the combusting fuel-and-air mixture. It is not always possible to arrange the heat exchanger assembly, furnace cabinet, and other components to reduce the generation of noise to a satisfactory low level. For example, in an induced draft combustion furnace that has a plurality of side-by-side heat exchangers, each with a monoport inshot burner, it is difficult to design a noise reduction system which would not lower the efficiency of the furnace, raise the level of NOx gases, or make the size of the components inordinately bulky.

Also, in an induced-draft inshot-burner type of furnace, it is highly desirable to have an even heating of the first or inlet course of the heat exchanger. That is, the metal walls of the heat exchanger are typically aluminized, and can suffer cracking or structural weakening if there are hot spots and ensuing thermal stressing in the heat exchanger walls.

OBJECTS AND SUMMARY OF THE INVENTION

Accordingly, it is an object of this invention to improve an inshot-type heat exchanger so as to reduce the level of noise created by the combustion process, and also to heat the inlet course of the heat exchanger evenly and without hot spots.

It is another object of this invention to reduce the noise level of the furnace without increasing the bulk or complexity of the furnace, and without measurable increase in NOx or other adverse combustion by-products.

In accordance with an aspect of this invention, the heat exchanger is provided with an aperture inlet plate. The inshot burner of the combustion furnace produces hot gaseous combustion which is injected through a rounded aperture in the inlet plate into a combustion zone in the heat exchanger on which the inlet plate is mounted. To provide smoother combustion and also to significantly reduce the noise level, the inlet plate has a bell or collar that surrounds the opening at its periphery and which extends inward a predetermined distance into the combustion zone. Preferably, the collar has a flared section where the collar joins to the main flat portion of the plate, and a straight or cylindrical section that extends thence into the heat exchanger. For a typical induced-draft combustion furnace, the inlet plate collar extends from about one-quarter inch to about one-half inch, and the flared section has a radius of curvature on the order of about one-quarter inch. The aperture and its associated collar, can have either a circular cross section or an oval cross section. It is believed that the flared inlet reduces turbulence in the burning zone which is introduced when secondary air is drawn in through the orifice plate aperture. This has a dual benefit of both reducing the noise level, typically by about 3–4 dB(A) overall and 4–8 dB at the frequencies of interest (125 and 250 Hz) and also produces rather even heating in the inlet pass or course of a four-pass heat exchanger. More specifically, the temperature patterns shift from the abrupt, high temperatures entering the cells and quickly dropping in temperature, characteristic of "flat" inlet plates. Instead, with the belled inlet plates, the initial temperatures are lower, and drop off more slowly across the length of the first pass.

The above and many other objects, features and advantages of this invention will be more fully understood from the ensuing description of selected preferred embodiments, which should be read in connection with the accompanying Drawing.

DETAILED DESCRIPTION OF THE PREFERRED EMBODIMENT

Figure 1:
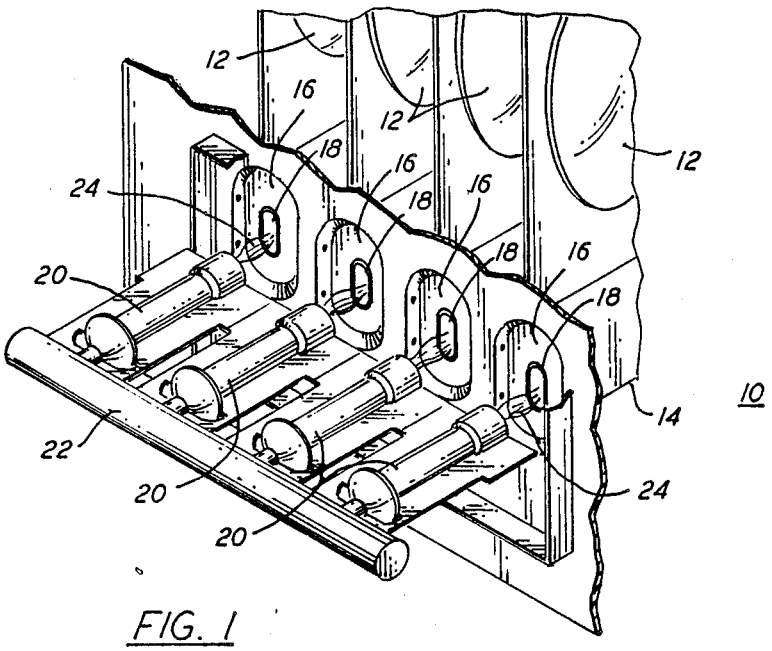
FIG. 1 is a partial perspective view of an induced draft combustion furnace in which there can be employed the belled inlet plates of this invention.

With reference to the Drawing, and initially to FIG. 1 thereof, a gas-fired furnace 10 has a plurality of heat exchanger cells 12 which can, for example, be S-shaped. A typical induced draft furnace is described in U.S. Pat. No. 4,476,850. Each cell 12 has a combustion chamber 14 defined within the first pass or course of the heat exchanger. An oval inlet plate 16 is situated within the opening to the chamber 14, and each inlet plate 16 has a round or oval opening 18 disposed slightly below center. Preferably, there are not other openings through the plate 16 into the chamber 14.

For the four cells 12, there are an associated four inshot-type gas burners 20 which are fed by a common gas supply pipe 22. These burners 20 each generate a respective flame 24 which is shot through the inlet plate opening 18 into the respective combustion chamber 14. Secondary combustion air is drawn in with the flame 24 through the oval or round opening 18. The abruptness of the flat passage through the opening 18 causes significant turbulence in the incoming secondary air, and this turbulence, in turn, creates noise.

Figures 2A, 2B, 3A, 3B, 4A, 4B:
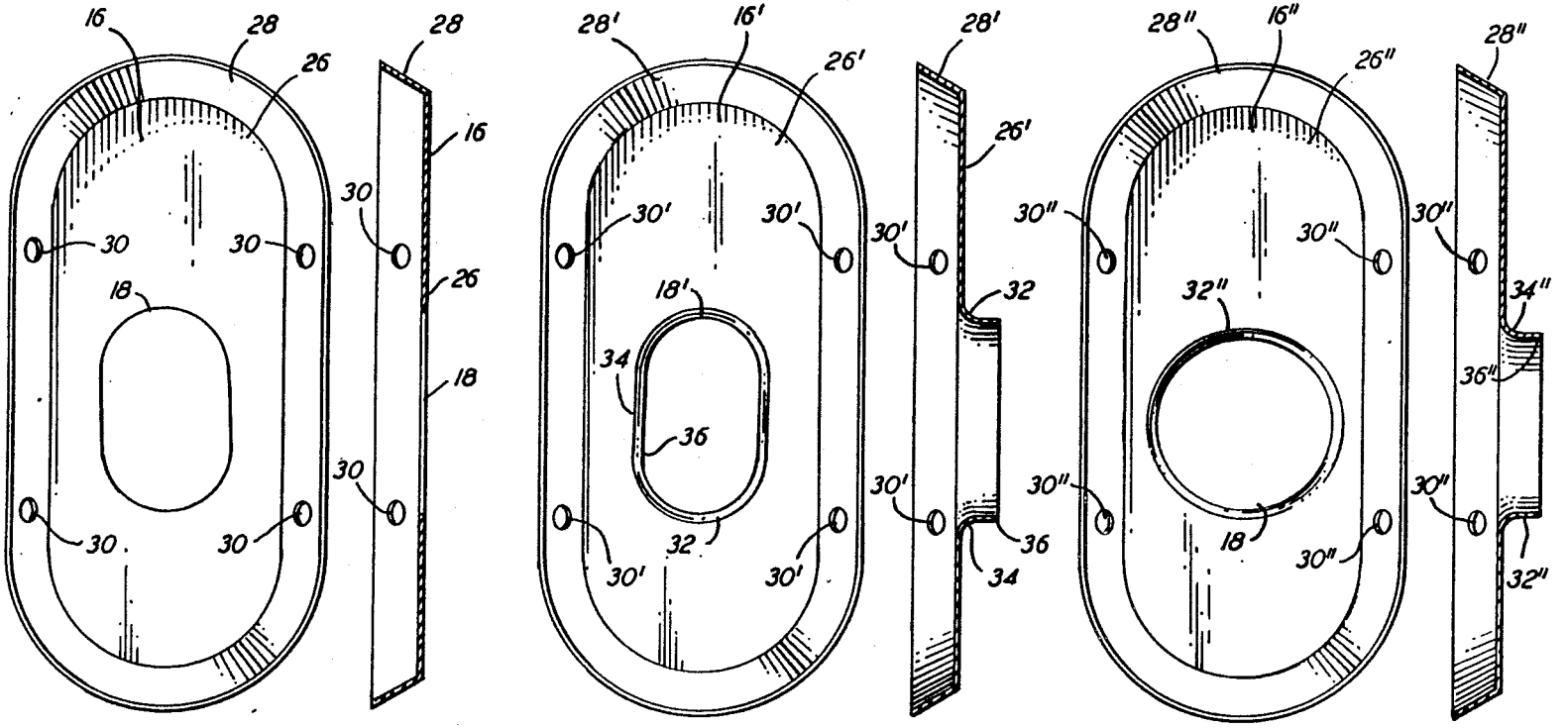
FIG. 2A Prior Art
FIG. 2B Prior Art
FIGS. 2A and 2B are plan and side elevational views, respectively, of a flat aperture inlet plate according to the prior art.
FIGS. 3A and 3B are plan and side elevational views, respectively, of an oval-belled aperture inlet plate according to an embodiment of this invention.
FIGS. 4A and 4B are plan and side elevational views, respectively, of a round-belled aperture inlet plate according to an embodiment of this invention.

The typical prior art inlet plate 16, as shown in FIGS. 2A and 2B, has an oval flat portion 26 that generally closes off the entrance to the heat exchanger cell 12, and a flange 28 that seats against a matching flange in the opening of the cell 12. Several holes 30 are provided in the flange 28 to receive machine screws for removably attaching the inlet plate 16 to the heat exchanger. The abruptness of the flat oval opening 18 can be appreciated from on side view of FIG. 2B.

An oval-opening inlet plate 16' which embodies this invention is shown in FIGS. 3A and 3B. Here, those elements which are identical with those of FIGS. 2A and 2B are identified with the same reference number, but primed. The aperture plate 16' has an oval opening 18'. The oval flat portion 26', the flange 28' and the flange screw holes 30; can be generally identical with those of the inlet plate 16 of FIGS. 2A and 2B. However, in this embodiment there is a bell or collar 32 that surrounds the opening 18' on the side facing into the heat exchanger. The bell 32 has a flared portion 34 which leads to a substantially straight wall portion. It is preferred that the flared portion 34 have a radius of curvature on the order of about 2% to 15% of the diameter of the opening, which in a preferred example, can be one-quarter inch, and with the bell 32 extending about one-quarter inch to one-half inch into the heat exchanger.

In a typical embodiment, the oval flat portion 26' has a major axis distance of about four inches and a minor axis distance of about two inches, while the oval opening 18' has a major-axis distance of about one and one-half inches and a minor-axis distance of one and one-eight inches. In one practical embodiment, the collar 32 has a depth of about five-sixteenths inch, while the radius of curvature of the flared portion is about seven thirty-seconds of an inch. Of course, the actual size of the aperture and of the inlet plate would depend on the dimensions of the associated heat exchanger and the combustion rate of the associated burner 20.

Another embodiment of the inlet plate of this invention is shown in FIGS. 4A and 4B. Elements that are the same as those in FIGS. 3A and 3B are identified with the same reference numbers, but double-primed. Here the inlet plate 16" has an opening 18" of round or circular cross section. The flat portion 26", flange 28" and screw holes 30" can be generally the same as in the previous embodiment. The round opening 18" is surrounded by a bell or collar 32" which is generally cylindrical, i.e., of circular cross section. This bell or collar 32" preferably has a flange portion 34" and a straight wall portion 36" which are generally of the same height and radius of curvature as the corresponding parts of the inlet plate 16' of FIGS. 3A and 3B.

In the case of either the round-aperture inlet plate of FIGS. 4A and 4B or the oval-aperture inlet plate of FIGS. 3A and 3B, the flared inlet reduces turbulence in the secondary air entering the burning zone which reduces burner noise.

Figure 5:
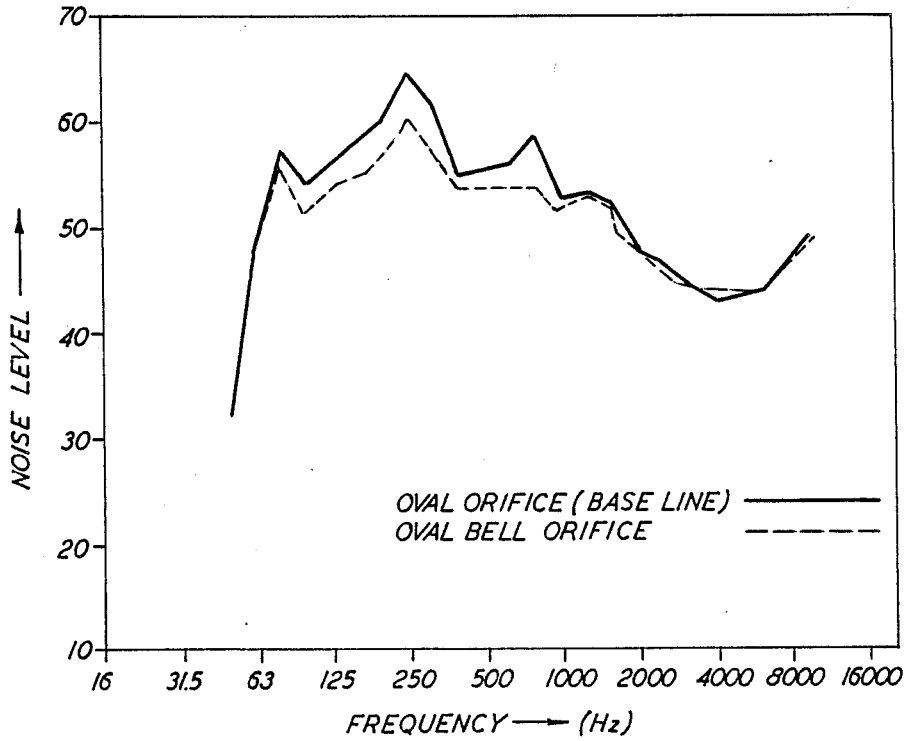
FIG. 5 is a chart showing comparative noise level test results for an induced draft combustion furnace that employs an inlet plate of the prior art and a corresponding inlet plate of the present invention.

FIG. 5 is a chart of noise level readings of an induction-type furnace with an inshot burner. The solid line curve shows the baseline noise level, i.e., the frequency dependence of noise for a burner with a standard or flat oval orifice plate, such as that of FIGS. 2A and 2B. The dash-line is the plot of similar data taken for an oval-bell orifice plate such as that of FIGS. 4A and 4B. The tests were conducted in a qualified laboratory sound room, and a laboratory grade real-time sound analyzer was employed to give the readings at one third octave spacings. The microphone for the sound level meter was kept at the same location for all phases of the test.

It is quite apparent from the comparison of the two graphs that there is a significant reduction of noise, particularly for middle frequencies, i.e., from about 63 Hz to about 1,000 Hz. In particular, for the frequency band about 250 Hz there is an improvement of more than 4dB when the bell orifice is employed. This is achieved without any other change in furnace configuration, and without any significant increase in NOx levels.

Moreover, the bell orifice plate 16' creates less combustion turbulence. Because of this, the boundary layer on the inner cell surface has a lower heat transfer coefficient and the heat transfer rate is lower. Consequently, there is a lower temperature gradient along the combustion path surface in the first pass. Because there is a more gradual gradient in cell temperatures, there is less thermal stress on the cells, which increases confidence in cell coating, and reduces occurrences of thermal stress cracks.

While the present invention has been described with reference to selected preferred embodiments, it should be understood that the invention is not limited to those precise embodiments. Rather, many modifications and variations would present themselves to those of skill in the art without departing from the scope and spirit of this invention, as defined in the appended claims.

What is claimed is:

1. An inlet plate for a heat exchanger of a combustion furnace in which an inshot burner produces hot gaseous combustion which is injected through a rounded aperture in the inlet plate into a combustion zone in the heat exchanger in which the plate is mounted; wherein said inlet plate includes a collar surrounding said aperture at its periphery and extending into said combustion zone, the collar having a flared section joining to a main flat portion of the plate and leading to a substantially straight walled section that ends a predetermined distance into the combustion zone.

2. The inlet plate of claim 1 wherein said aperture is circular and said collar is generally cylindrical.

3. The inlet plate of claim 1 wherein said aperture is generally oval and said collar has an oval cross section.

4. The inlet plate of claim 1 wherein said collar extends substantially ¼ inch to ½ inch.

5. The inlet plate of claim 1 wherein said flared section has a radius of curvature on the order of ¼ inch.

6. The inlet plate of claim 1 wherein said aperture plate is free of any openings into said combustion zone other than said rounded aperture.

7. The inlet plate of claim 1 wherein flared section has a radius of curvature that is between about 2% and 15% of the diameter of the aperture.

8. The inlet plate of claim 1 wherein said straight walled section is substantially perpendicular to the main flat portion of the plate.

* * * * *